US006915564B2

(12) United States Patent
Adams

(10) Patent No.: US 6,915,564 B2
(45) Date of Patent: Jul. 12, 2005

(54) METHOD AND APPARATUS FOR MANUFACTURING COAXIAL CABLE WITH COMPOSITE INNER CONDUCTOR

(75) Inventor: Scott M. Adams, Catawba, NC (US)

(73) Assignee: Commscope Properties LLC, Sparks, NV (US)

( * ) Notice: Subject to any disclaimer, the term of this patent is extended or adjusted under 35 U.S.C. 154(b) by 32 days.

(21) Appl. No.: 10/324,830

(22) Filed: Dec. 20, 2002

(65) Prior Publication Data

US 2004/0118580 A1 Jun. 24, 2004

(51) Int. Cl.[7] ..... H01B 13/20
(52) U.S. Cl. ..... 29/828; 29/825; 228/148; 228/156
(58) Field of Search ..... 29/825, 828; 228/148, 228/156

(56) References Cited

U.S. PATENT DOCUMENTS

| | | | | |
|---|---|---|---|---|
| 3,430,330 A | * | 3/1969 | Garner | 228/148 |
| 3,567,846 A | * | 3/1971 | Brorein et al. | 174/102 R |
| 3,710,440 A | | 1/1973 | Nevin et al. | |
| 3,717,719 A | | 2/1973 | Smith et al. | 174/107 |
| 3,737,997 A | | 6/1973 | Davis | |
| 3,824,300 A | | 7/1974 | Raffenberg | |
| 3,968,918 A | | 7/1976 | Merle | 228/148 |
| RE28,961 E | | 9/1976 | Tsukamoto et al. | |
| 3,985,948 A | | 10/1976 | Olszewski et al. | 174/28 |
| 4,083,484 A | * | 4/1978 | Polizzano et al. | 228/130 |
| 4,407,065 A | * | 10/1983 | Gray | 29/828 |
| 4,741,470 A | | 5/1988 | Winter et al. | 228/148 |
| 5,759,454 A | | 6/1998 | Le Gac et al. | 264/1.28 |
| 5,807,514 A | | 9/1998 | Grinshpun et al. | 264/46.6 |
| 5,946,798 A | | 9/1999 | Buluschek | 29/828 |
| 6,326,551 B1 | | 12/2001 | Adams | 174/113 |

FOREIGN PATENT DOCUMENTS

GB 1007939 A 10/1965

* cited by examiner

*Primary Examiner*—Carl J. Arbes
(74) *Attorney, Agent, or Firm*—Allen, Dyer, Doppelt, Milbrath & Gilchrist, P.A.

(57) ABSTRACT

A method of making a coaxial cable includes forming a conductive tube and setting a settable material therein to define an inner conductor. Forming may include advancing a conductive strip and bending it into a tube having a longitudinal seam. The settable material may be dispensed onto the conductive strip continuously with the forming. Alternately, the settable material may be dispensed onto the conductive strip prior to advancing. The dispensing may use a puller cord as the settable material or carrying some or all of the settable material. The method may further include forming a dielectric layer surrounding the inner conductor, and forming an outer conductor surrounding the dielectric layer.

34 Claims, 11 Drawing Sheets

METHOD AND APPARATUS FOR MANUFACTURING COAXIAL CABLE WITH COMPOSITE INNER CONDUCTOR

FIELD OF THE INVENTION

The present invention relates to the field of cables, and, more particularly, to coaxial cables.

BACKGROUND OF THE INVENTION

Coaxial cables are widely used to carry high frequency electrical signals. Coaxial cables have a relatively high bandwidth and low signal losses, are mechanically robust, and are relatively low cost. A coaxial cable typically includes an elongate inner conductor, a tubular outer conductor, and a dielectric separating the inner and outer conductors. The dielectric may be, for example, a plastic foam material. An outer insulating jacket may be applied to surround the outer conductor.

One particularly advantageous use of coaxial cable is for connecting electronics at a cellular or wireless base station to an antenna mounted at the top of a nearby antenna tower. For example, the transmitter and receiver located in an equipment shelter may be coupled via coaxial cables to antennas carried by the antenna tower. A typical installation includes a relatively large diameter main coaxial cable extending between the equipment shelter and the top of the antenna tower to thereby reduce signal losses. For example, CommScope, Inc. of Hickory, N.C., offers its CellReach® coaxial cable for such applications.

With respect to such large diameter main coaxial cables in particular, CommScope typically uses a composite inner conductor that includes a dielectric rod surrounded by a conductive tube. Since the skin depth at the operating frequencies is relatively shallow, the conductive tube can be used to reduce costs and provide good mechanical properties. The conductive tube is typically formed by shaping a metal strip into a tube and welding the longitudinal seam. The dielectric rod also acts to block moisture within the tube.

U.S. Pat. No. 6,326,551 to Adams discloses a coaxial cable having a composite core comprising a welded tubular inner conductor with a water absorbing material therein. The composite core not only supports the cable during bending and promotes the maintenance of good signal transmission performance, but also protects against corrosion causing moisture getting into the cable.

The manufacture of such a coaxial cable thus usually entails not only a separate step of pre-forming the dielectric rod, but also properly positioning it relative to a conductive strip or other material from which the conductive tube is to be formed. Such multi-step manufacturing can be complex and time consuming. Accordingly, it can also add considerably to the costs of manufacturing a coaxial cable with a composite core.

SUMMARY OF THE INVENTION

In view of the foregoing background, it is therefore an object of the present invention to provide a method and apparatus for efficiently making a coaxial cable that has a composite core.

This and other objects, features, and advantages in accordance with the present invention are provided by a method for making a coaxial cable that includes forming a conductive tube and setting a settable material within the conductive tube to thereby define an inner conductor. The method further includes forming a dielectric layer around the inner conductor, and forming an outer conductor around the dielectric layer. The settable material may be water-blocking as well as supportive, and the method permits, for example, the manufacture of such a coaxial cable in a single pass so that it is made more efficiently and at a reduced cost relative to other modes of manufacturing such cables.

Accordingly, forming the dielectric layer and outer conductor may be performed continuously with the forming of the conductive tube. The setting may comprise setting the settable material so that it completely fills the conductive tube and thereby provides an effective water block. Alternately, the settable material may radially fill longitudinally spaced apart portions of the inner conductor. The method may also include setting the settable material so that it forms a stabilized inner conductor, after which the coaxial cable may be wound onto a take-up reel.

The settable material may also be expandable. Thus the method may include expanding the settable and expandable material within the conductive tube. Setting and/or expanding of the material, moreover, may include a setting and/or an expansion involving at least one of a chemical reaction, a temperature change, a pressure change, or exposure to optical energy, for example.

The forming of the conductive tube according to the method may include advancing a conductive strip along a path of travel, bending the conductive strip into a tube having a longitudinal seam, and welding the longitudinal seam. The method additionally may include reducing a diameter of the conductive tube after welding.

The settable material may be dispensed onto the conductive strip continuously with the forming of the conductive tube in some embodiments. Alternately, the settable material may be dispensed onto the conductive strip prior to advancing the conductive strip along the path of travel. The settable material may comprise at least one of polyurethane, polystyrene, and polyolefin.

In some advantageous embodiments, at least one elongate pulling member may be secured within the conductive tube to dispense the settable material. For example, the at least one pulling member may carry at least part of the settable material. The pulling member or pull cord may be supplied from a supply reel, for example.

The method also may include applying an adhesive layer within the conductive tube. The method further may include forming a jacket surrounding the outer conductor. And forming the jacket may be performed continuously with forming the inner conductor, dielectric layer, and outer conductor.

Another aspect of the invention relates to an apparatus for making the coaxial cable. The apparatus may include a conductive tube former for forming a conductive strip into a conductive tube surrounding a settable material to define an inner conductor. A dielectric former may be provided downstream of the tube former for forming a dielectric layer surrounding the inner conductor, and an outer conductor former may be provided downstream of the dielectric former for forming an outer conductor surrounding the dielectric layer.

Still another aspect of the invention relates to a coaxial cable including an inner conductor comprising a conductive tube, a set material within the tube, and at least one elongate member embedded within the set material. Of course, the coaxial cable may also include a dielectric layer surrounding the inner conductor, and an outer conductor surrounding the dielectric layer. The at least one elongate member may comprise at least one pull cord.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime and multiple prime notation indicate similar elements in alternate embodiments.

Figure 1:
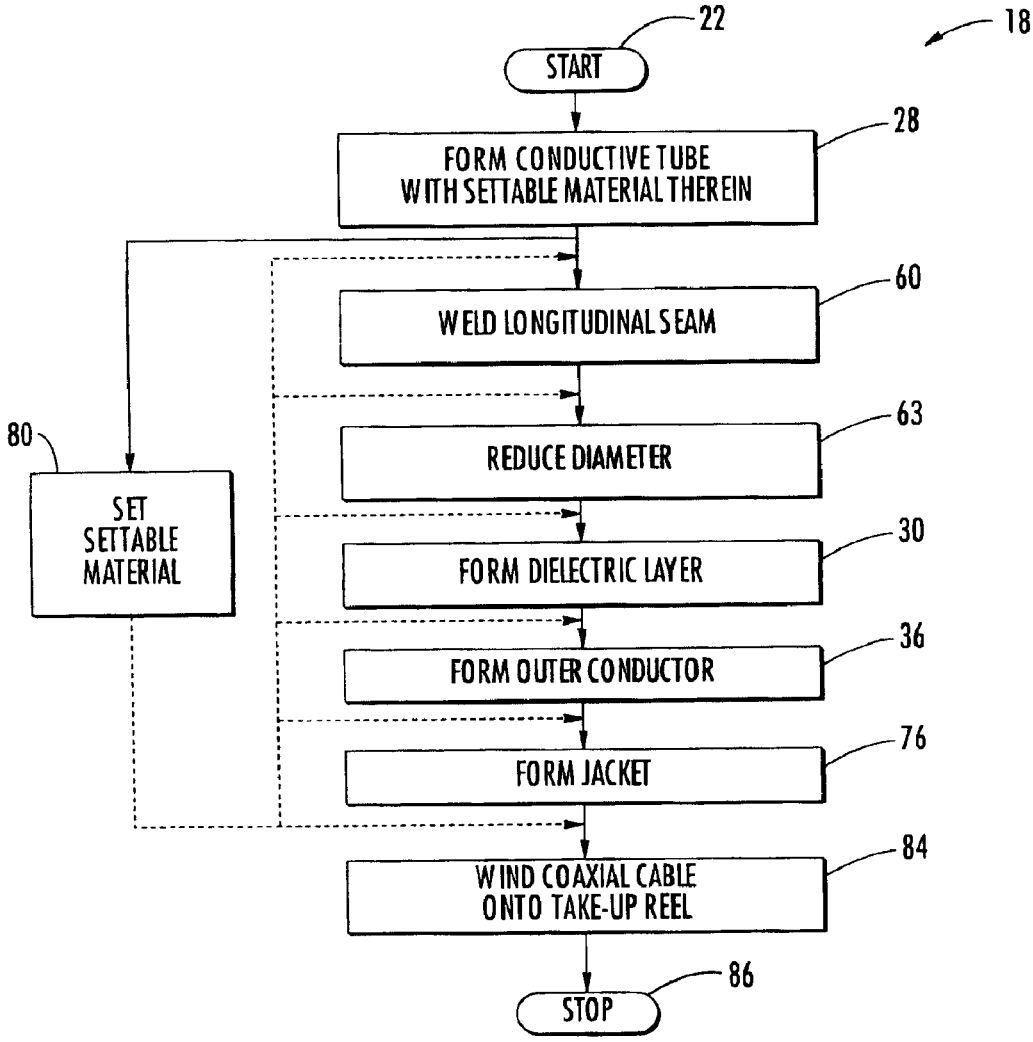
FIG. 1 is a flow diagram of a method of making coaxial cable having a composite core according to the present invention.
Figure 2:
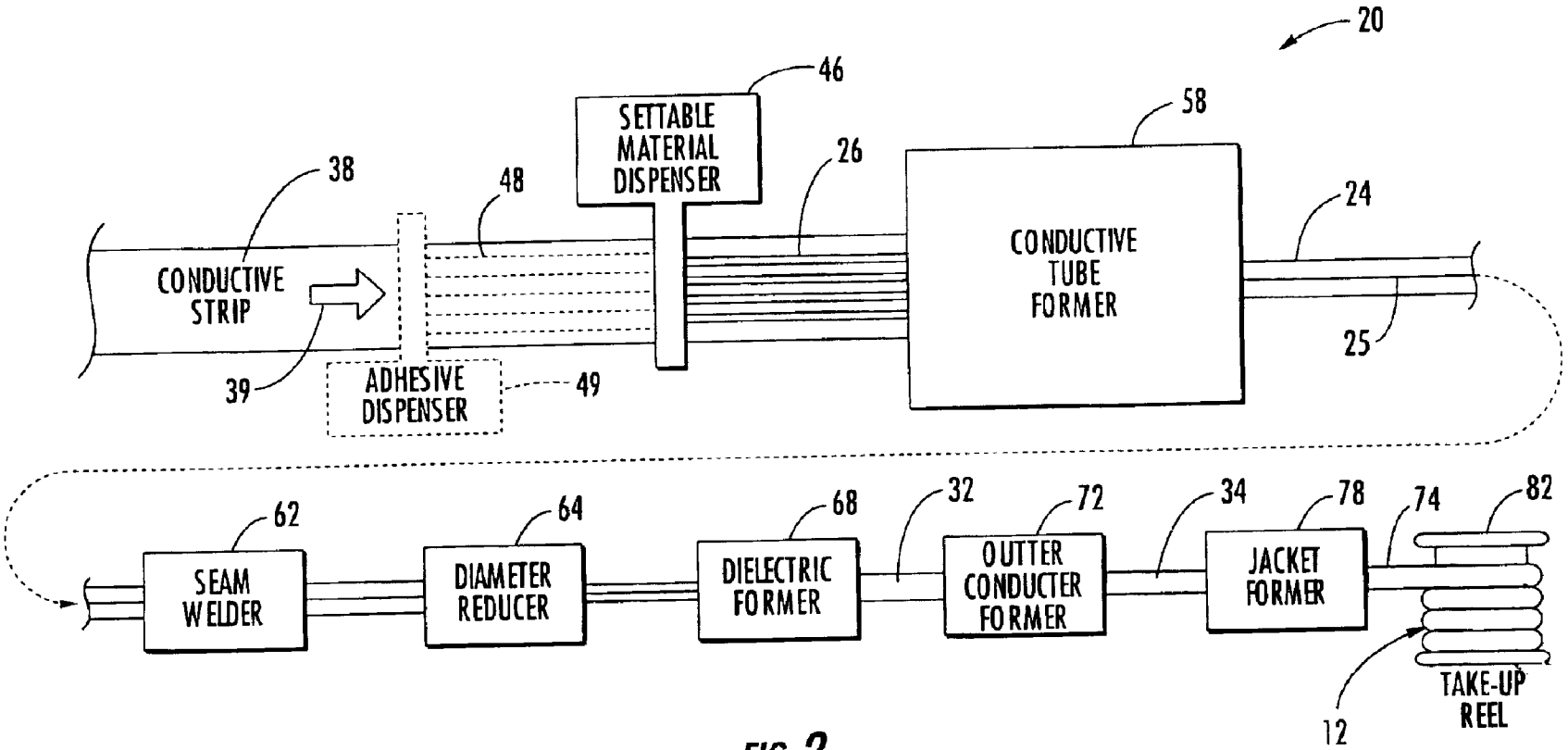
FIG. 2 is a schematic diagram of an apparatus for implementing the method illustrated by the flow diagram in FIG. 1.
Figure 3:
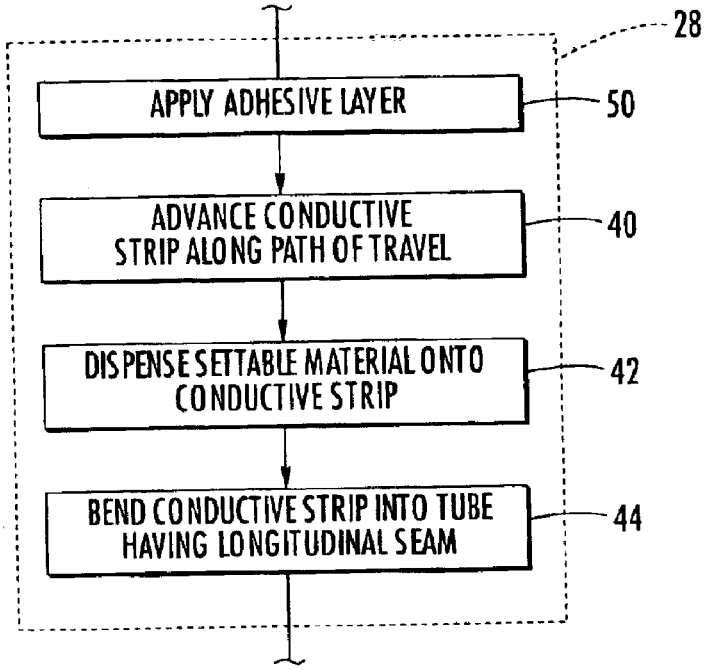
FIG. 3 is a more detailed flow diagram of portions of the flow diagram in FIG. 1.

Referring initially to FIGS. 1–3, a method and apparatus 20 of making coaxial cable 12 according to the present invention are described. As illustrated by the steps of flow diagram 18, after the start (Block 22), the method illustratively continues with the formation of a conductive tube 24 (Block 28) with settable material 26 therein. The setting of a settable material 26 occurs within the conductive tube (Block 80), thereby defining an inner conductor. As indicated by the dashed lines, the setting may occur nearly instantaneously, or during the remaining steps. It may be desirable that the settable material 26 be sufficiently set at least prior to winding onto the take-up reel 82 to be mechanically stable to avoid buckling, for example.

A dielectric layer 32 is formed around the conductive tube 24 at Block 30. An outer conductor 34 is formed around the dielectric layer at Block 36.

The apparatus 20 illustratively includes a settable material dispenser 46 for dispensing the settable material 26 onto the conductive strip 38, and a conductive tube former 58 downstream of the settable material dispenser to form the conductive strip into a tube continuously with the dispensing of the settable material. Additionally, the apparatus 20 illustratively includes a dielectric former 68 downstream of the conductive tube former 58 to form the dielectric layer 32 around the inner conductor, and an outer conductor former 72 downstream of the dielectric former to form the outer conductor 34 around the dielectric layer.

As illustrated, the forming of the conductive tube 24 and the setting of the settable material 26 include advancing a conductive strip 38 along a path of travel (indicated by the arrow 39 in FIG. 2) at Block 40 and dispensing the settable material onto the conductive strip at Block 42 continuously with the forming of the conductive tube 24. The conductive strip 38 is illustratively formed into the conductive tube 24 at Block 44 by bending the conductive strip as the conductive strip is advanced along the path of travel 39 as explained in more detail below. The tube former 58 may be provided by a series of forming rolls as will be appreciated by those skilled in the art.

Prior to the dispensing, an adhesive layer 48 may optionally be applied to the surface of the conductive strip 38 at Block 50 with an adhesive dispenser 49 that is optionally provided upstream of the settable material dispenser 46 along the path of travel 39. As will be readily appreciated by those skilled in the art, the adhesive layer 48 may serve to better bind the settable material 26 to the surface of the conductive strip 38.

Although the settable material 26 is illustratively dispensed by the settable material dispenser 46 just upstream from the conductive tube former 58, it will be readily understood by those skilled in the art that the settable material may be dispensed as the conductive strip 38 is actually being shaped into a tube. It will be readily appreciated those skilled in the art that, using known injecting methods, the settable material may be injected into the conductive tube 24 as or just after it is formed. In any event, as explained below, it is the setting of the settable material 26 during the manufacturing steps that provides many of the efficiency advantages.

Figure 4:
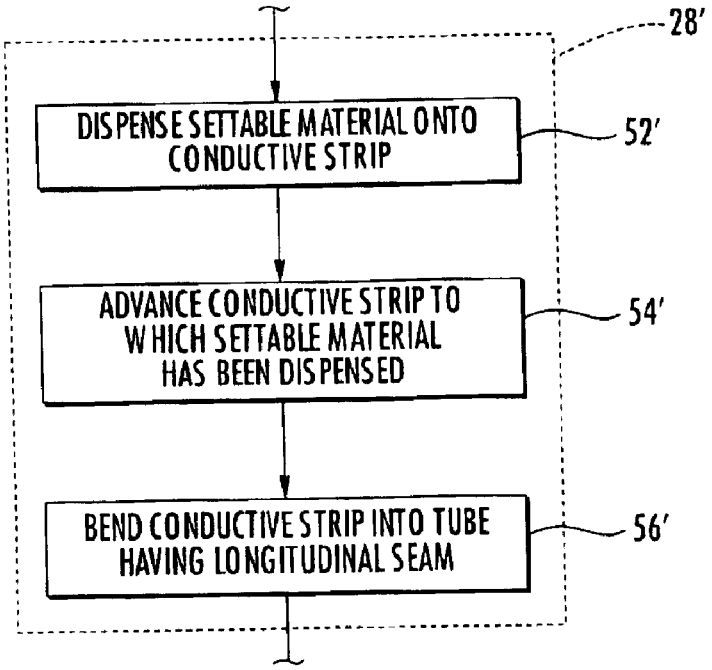
FIG. 4 is a more detailed flow diagram of an alternate embodiment of portions of the flow diagram in FIG. 1.
Figure 5:
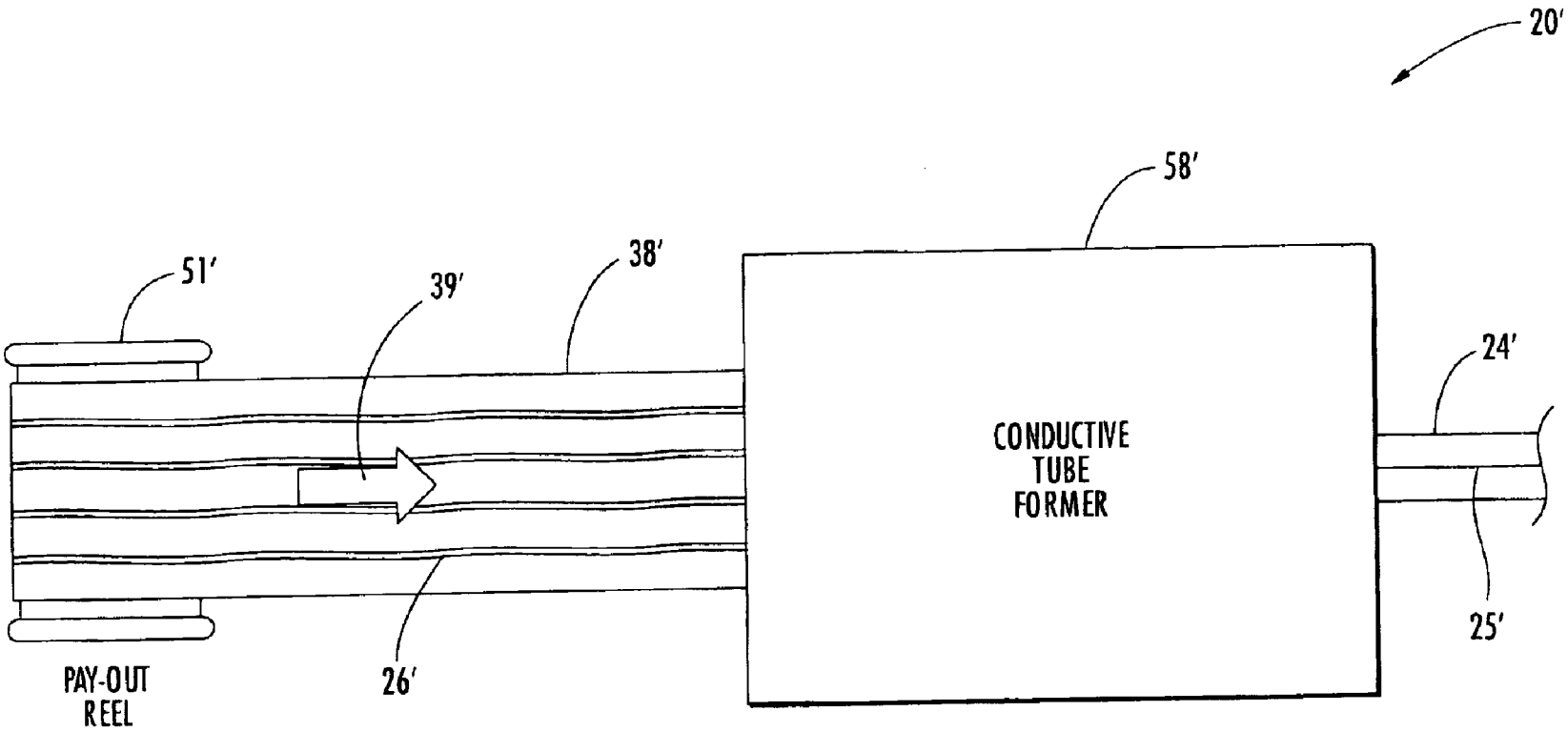
FIG. 5 is a schematic diagram of an alternate embodiment of an apparatus for making coaxial cable according to the method illustrated by the flow diagram of FIG. 4.

Moreover, though the settable material is illustratively dispensed onto the conductive strip 38 with the formation of the conductive tube 24 by the conductive tube former 58, it will further be readily appreciated by those skilled in the art that the settable material need not be dispensed in-line with the tube formation. Instead, the settable material 26 may be dispensed onto the conductive strip 38 separately or off-line from the formation of the conductive tube 24 by the conductive tube former 58 as now explained with additional reference to FIGS. 4–5.

The forming of the conductive tube 24' and the setting of the settable material 26' at Block 28' begins with the dispensing of the settable material onto the conductive strip 38' prior to advancing the conductive strip for forming it into a conductive tube (Block 52). Accordingly, as noted above, the settable material 26' may be dispensed onto the conductive strip 38' at a location different from where the other processing steps are performed and/or by a manufacturer different from the coaxial cable manufacturer.

The apparatus 20' includes a conductive strip supply 51' for supplying the conductive strip 38' on which the settable material 26' has already been dispensed. Illustratively, the conductive strip supply 51' is a pay-out reel, and the conductive strip 38' is supplied directly therefrom during the forming of the conductive tube 24'. With the settable material 26' already dispensed onto its surface, the conductive strip 38' is advanced (Block 54) and formed into the conductive tube 24' by bending at Block 56 so that the settable material 26' is within the conductive tube.

With the settable material 26, 26' contemporaneously or previously applied to the surface of the conductive strip 38, 38', the succeeding manufacturing steps may proceed as the settable material sets within the conductive tube 24, 24' formed by the bending of the conductive strip. The apparatus 20, 20' and related methods accordingly eliminate conventional steps typically employed in the manufacture of coaxial cable having a composite core. In contrast to conventional manufacturing devices and methods that first form a rod and then position the rod so that the conductive tube can be formed around it, the present invention permits the conductive tube 24, 24' to be made contemporaneously or nearly so with the setting of the settable material 26, 26' therein. The result is a more efficiently made inner conductor having a composite core that blocks entry of corrosion-inducing moisture while also providing enhanced support to the coaxial cable 12, 12'.

Figure 6:
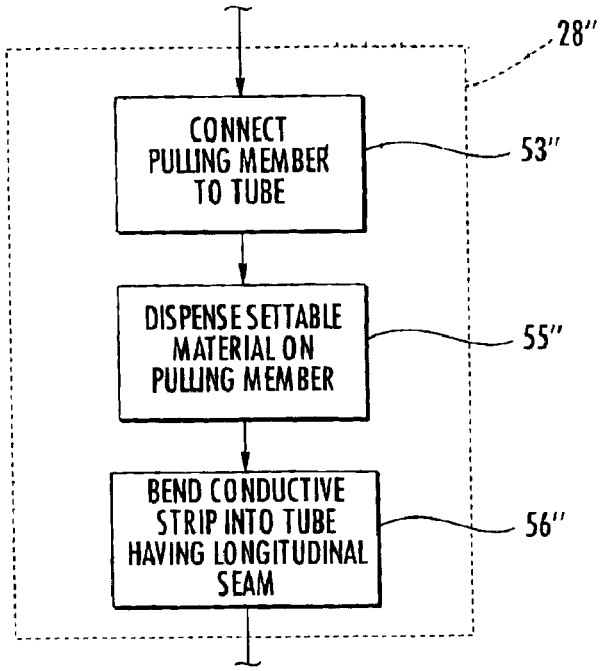
FIG. 6 is a more detailed flow diagram of another alternate embodiment of portions of the flow diagram in FIG. 1.
Figure 7:
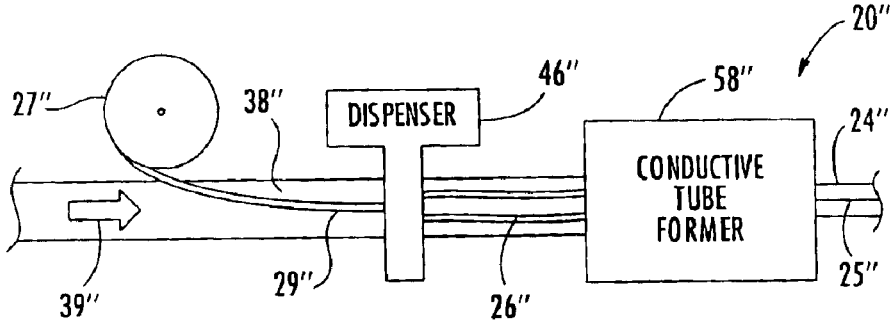
FIG. 7 is a schematic diagram of a portion of another alternate embodiment of an apparatus for making coaxial cable according to the method illustrated by the flow diagram of FIG. 6.

Turning now additionally to FIGS. 6 and 7, another variation of the method and apparatus 20" are now described. In this embodiment, a pulling member or pull cord 29" is used to help dispense the settable material 26" into the inner conductor 24". More particularly, the pulling member 29" is paid out from its supply reel 27" and the end of the pulling member is stuffed or otherwise secured into the tube 24" (Block 53"). A dispenser 46" dispenses the settable material 26" onto the pulling member 29" at Block 55" and the conductive strip is bent into the tube at Block 56". Accordingly, the pulling member 29" serves to drag the settable material 26" into the conductive tube 24". Moreover this approach may allow relatively precise metering of the quantity of settable material 26".

The pulling member 29" could be any of the following materials: natural or synthetic textile materials and yarns, woven fabrics, plastic, glass reinforced epoxy (fiberglass), optical glass, glass roving, rubber, or wire, for example. Those of skill in the art will appreciate other materials may be used as well. The pulling member 29" could also include at least part of the settable material in some embodiments. For example, the pulling member 29" could comprise one part of a two part mixture. The pulling member 29" could also be coated with part or all of the settable material, such as by passing the member through an immersion type applicator or dispenser, a flooding applicator, a powder application or other type of applicator or dispenser. Of course, the material could be applied or dispensed onto the pulling member prior to pay out from the supply reel 27" in some embodiments. In addition, more than one pulling member 29" could also be used in other embodiments.

The pulling member 29" may be constructed or modified to increase its capacity to carry the settable material 26". For example, the pulling member may be a textile yarn or woven fabric that would absorb the settable material. The pulling member 29" may be manufactured by molding, extrusion, machining, assembly, or other operation, which has the effect of increasing the surface area to carry more settable material 26". The pulling member 26" could be formed to have external features extending radially outward like ribs, fins, bosses, discs or bristles, for example. These external features could increase the carrying capacity by adding more surface area and also disperse the settable material in the desired radial profile pattern, either uniformly or nonuniformly distributed along the length of the cable. As will be appreciated by those skilled in the art, depending on the type of settable material and the technique employed for activating and setting the material, the pulling member 29" and/or its external features may be useful for conducting heat and/or transporting chemical reactants, gasses, electricity, or optical energy through the structure to assist curing.

Figure 8:
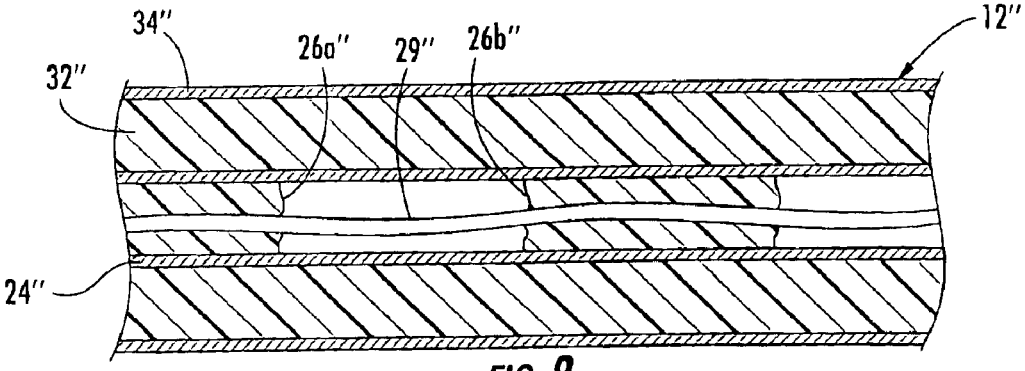
FIG. 8 is a longitudinal cross-sectional view of a cable embodiment according to the invention.

The pulling member 29" also permits the manufacturer to disperse the settable material in a desired pattern of longitudinally spaced apart positions as seen with reference to FIG. 8. In particular, spaced apart plugs **26*a*", 26*b*" may be formed within the conductive tube 24" of the cable 12". The cable 12" also illustratively includes the dielectric layer 32" and the outer conductor 34". Such an arrangement of spaced plugs 26*a*", 26*b*" prevents water or moisture migration through the inner conductor, and may relax metering accuracy requirements for the settable material 26" as will be appreciated by those skilled in the art. The spaced plugs 26*a*", 26*b*" also reduce the quantity and thus cost of the settable material needed for the cable 12". Of course, the spaced plugs 26*a*", 26*b*"** can also be produced using the other manufacturing methods discussed herein as will also be appreciated by those skilled in the art.

The settable material 26 may also be expandable. For example, the settable material may be any of a variety of thermosetting or thermoplastic resins such as polyurethane, polystyrene, or polyolefin. Accordingly, as will be appreciated by those skilled in the art, the settable material may, for example, be pumped and metered as a viscous liquid coating onto the conductive strip prior to the conductive strip being formed into a tube. The viscous liquid coating, as will also be understood by those skilled in the art, can be formulated to be expandable such that the expansion occurs to a desired extent and at a desired rate during manufacturing.

Figure 9A:
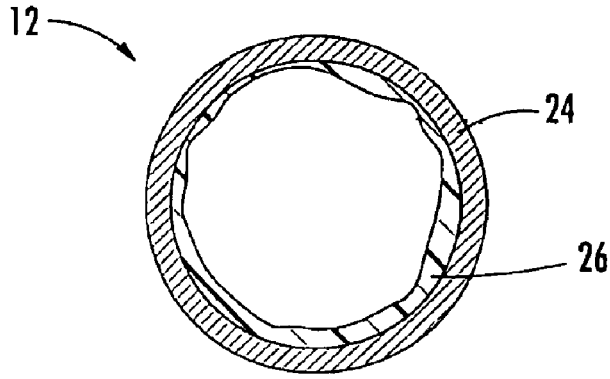
FIGS. 9A–9C are transverse cross-sectional views of a portion of the coaxial cable during the setting of a settable material according to the present invention.
Figure 9B:
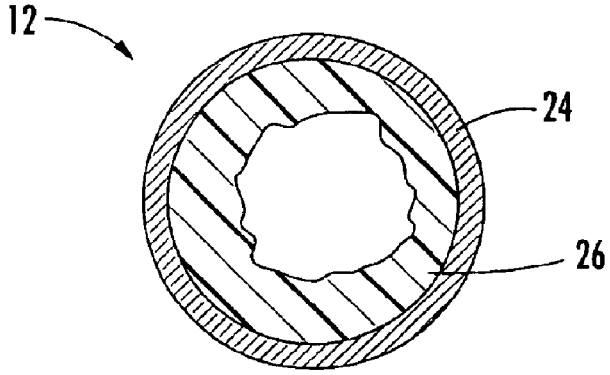
Figure 9C:
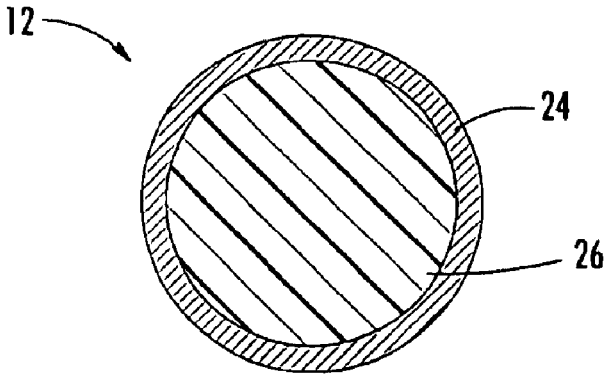

With the settable material being contemporaneously or previously applied to the conductive strip, the expansion and/or setting can be activated during the forming of the coaxial cable by processes known to those skilled in the art. These may involve at least one of a chemical reaction, a temperature change, a pressure change, and optical activation. Accordingly, after and/or during the formation of the conductive tube, the settable and expandable material may expand as illustrated in FIGS. 9A–9C.

Figure 10:
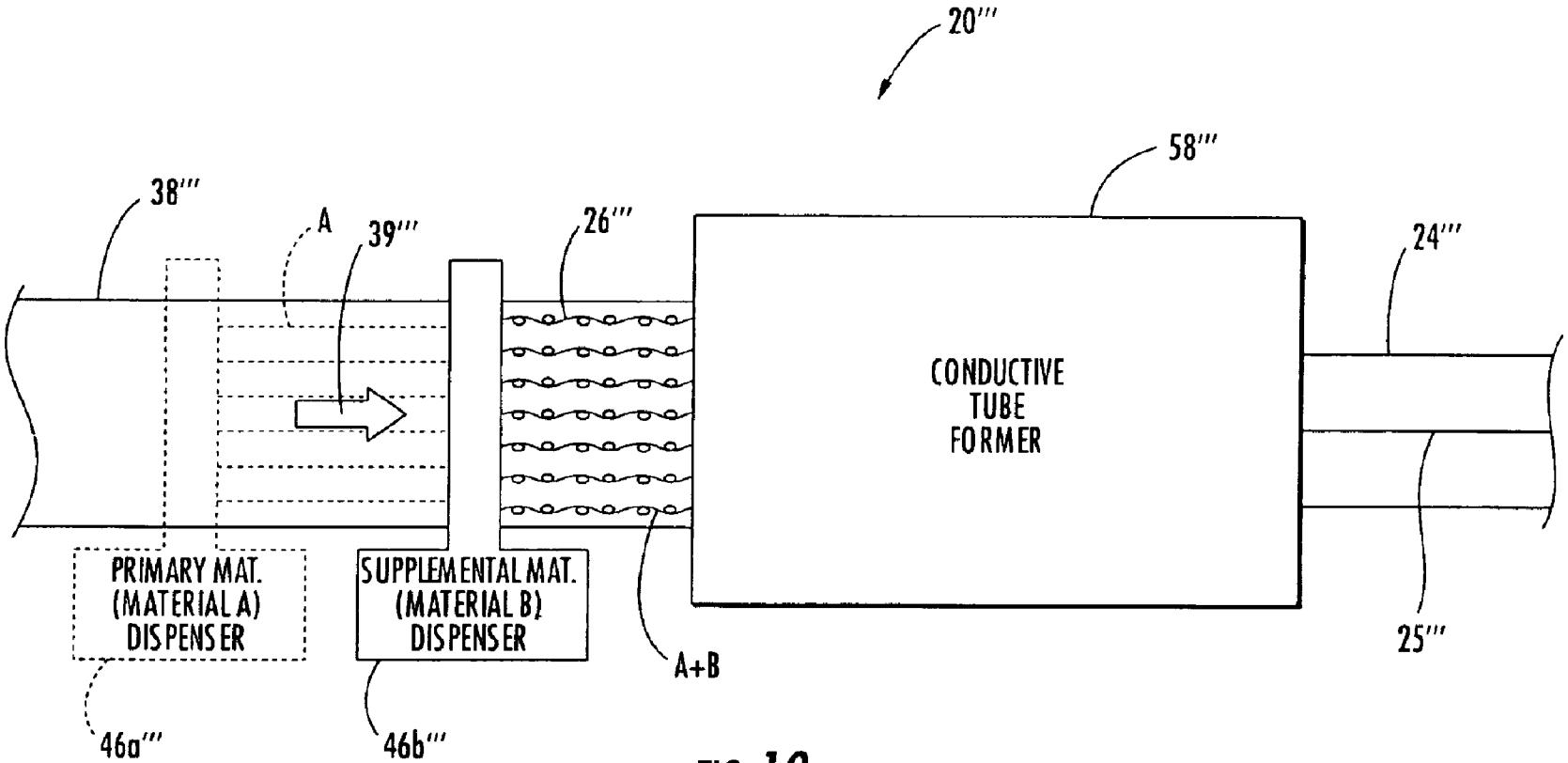
FIG. 10 is a schematic diagram of another embodiment of the apparatus for making coaxial cable according to the invention.

As illustrated in FIG. 10, in another embodiment the apparatus 20'" may further include a supplemental material dispenser **46*b*'" for applying an activating chemical or material (i.e., material B) onto the conductive strip 38'" to initiate the setting and/or expansion of material A from the primary dispenser 46*a*'". In other words, the settable material 26'" thus comprises two starting materials (i.e., materials A and B). For example, materials A and B may be precursors for an epoxy compound, or polyurethane. In other embodiments, the primary material (material A) may already have been dispensed onto the conductive strip 38'"** before it is supplied for further processing. One skilled in the art will readily appreciate that more than two chemicals or materials may be used to create and activate the settable material.

Figure 11:
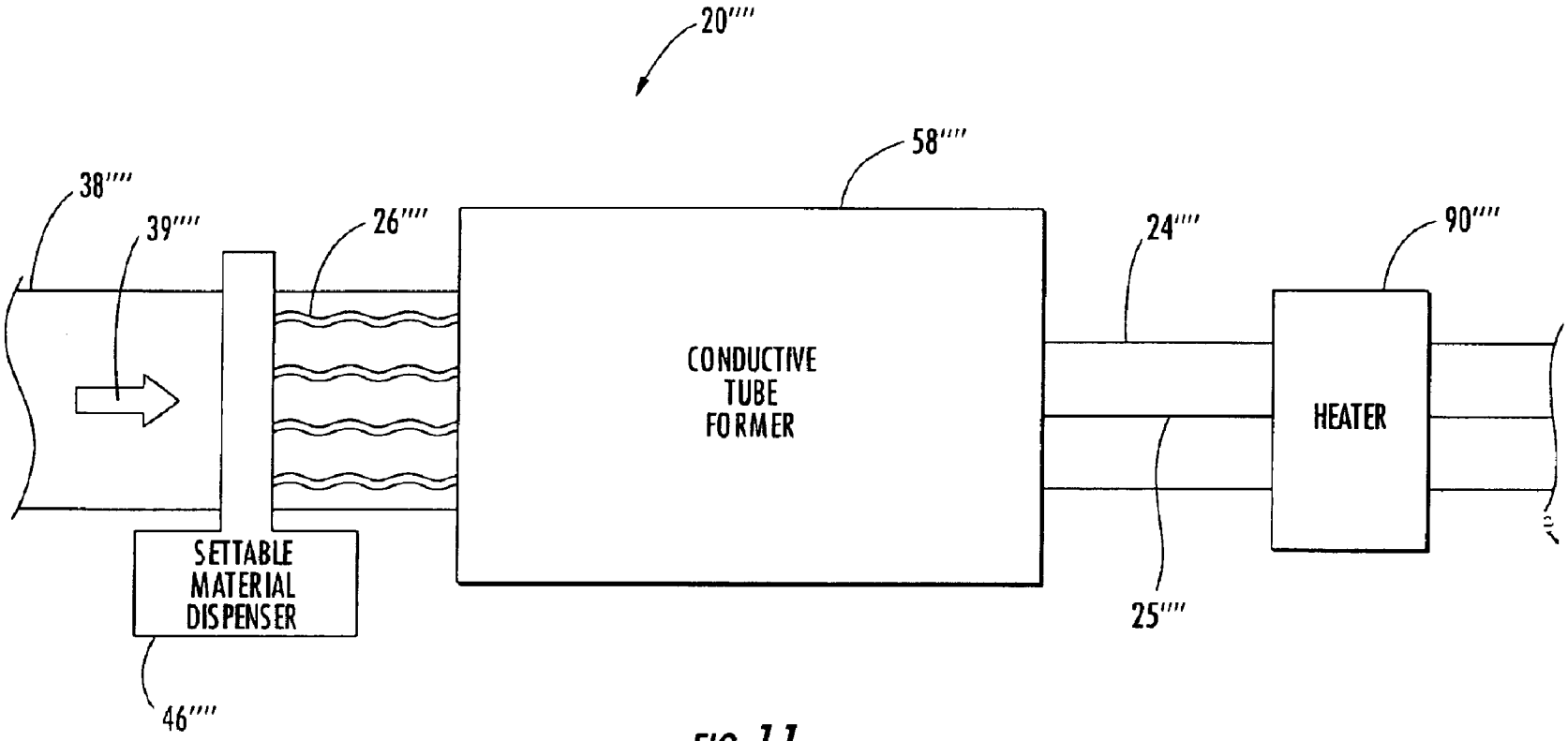
FIG. 11 is a schematic diagram of yet another embodiment of the apparatus for making coaxial cable according to the invention.

The embodiment of the apparatus 20"" illustrated in FIG. 11 includes a heater 90"" that supplies heat to the conductive tube 24"" formed by the conductive tube former 58"". The heat supplied by the heater 90"", as will be readily understood by those skilled in the art, may be used to set and/or expand the settable material 26"". It will be readily appreciated by those skilled in the art, that the heater 90"" may be positioned at other locations as well.

Figure 12:
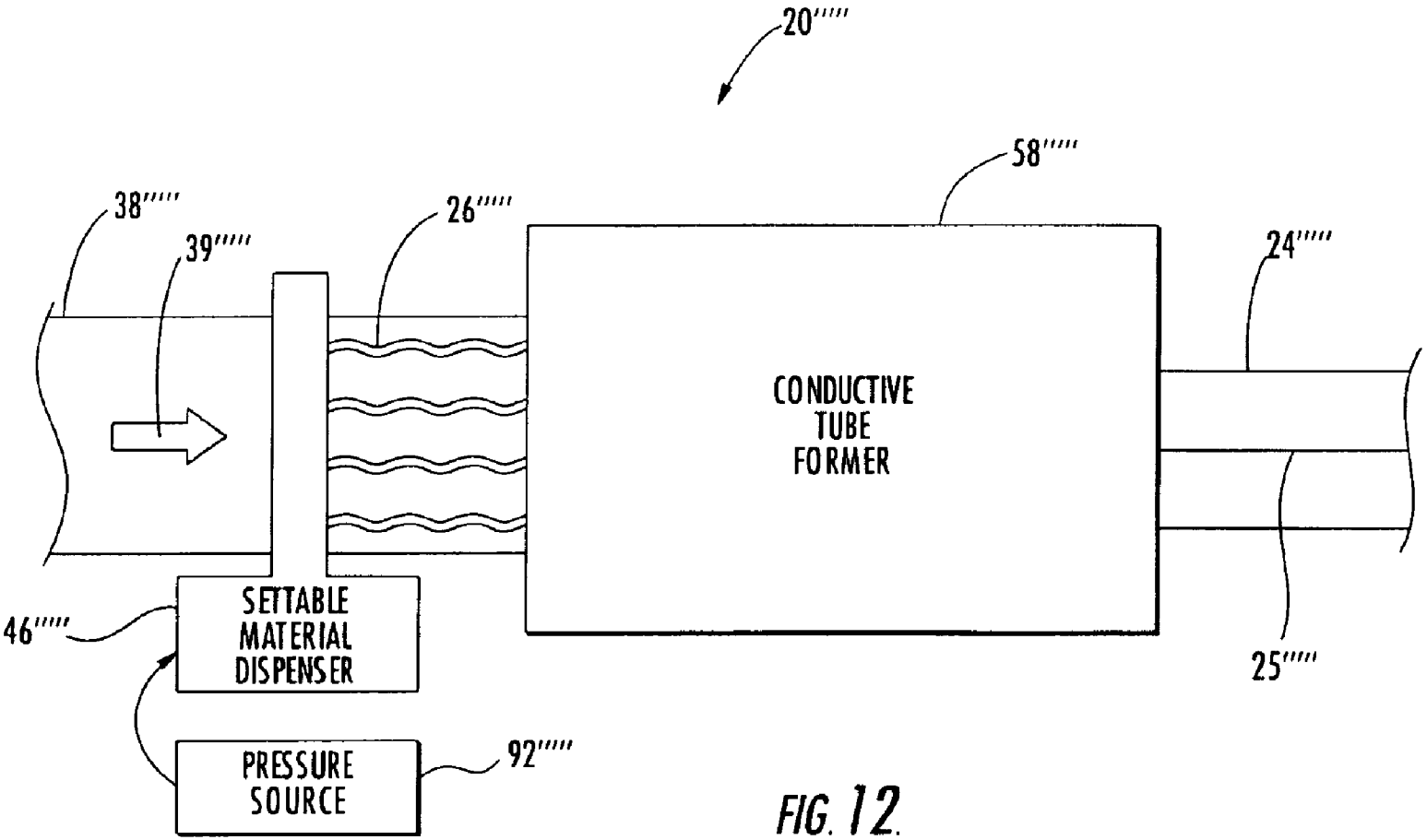
FIG. 12 is a schematic diagram of still another embodiment of the apparatus for making coaxial cable according to the invention.

As explained with reference to FIG. 12, the settable material may be set and/or expanded by pressure change. Accordingly, the apparatus 20""" includes a pressure source 92""" that supplies pressure to the settable material dispenser 46""", which causes the settable material 26""" to expand as it is dispensed onto the conductive strip 38"".

Figure 13:
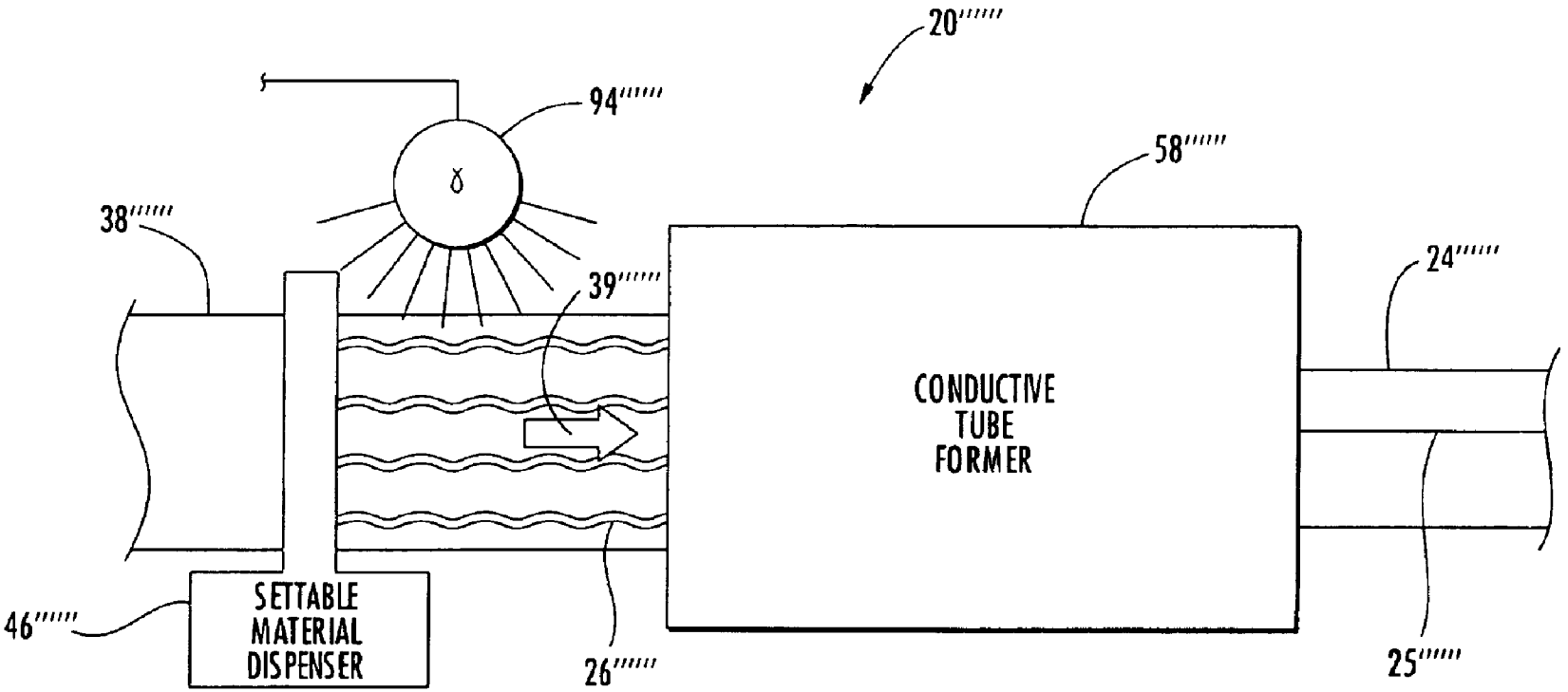
FIG. 13 is a schematic diagram of another embodiment of the apparatus for making coaxial cable according to the invention.

Still further, as illustrated in FIG. 13, the apparatus 20""" may include a source 94""" for optically setting and/or expanding the settable material 26""". As will be readily understood by one skilled in the art, the source 94""" may provide light at a predetermined wavelength. The settable material 26""", again, may be dispensed onto the conductive strip 38""" by the settable material dispenser 46""", or, may have already been dispensed thereon before the conductive strip is supplied for further processing.

Figure 14:
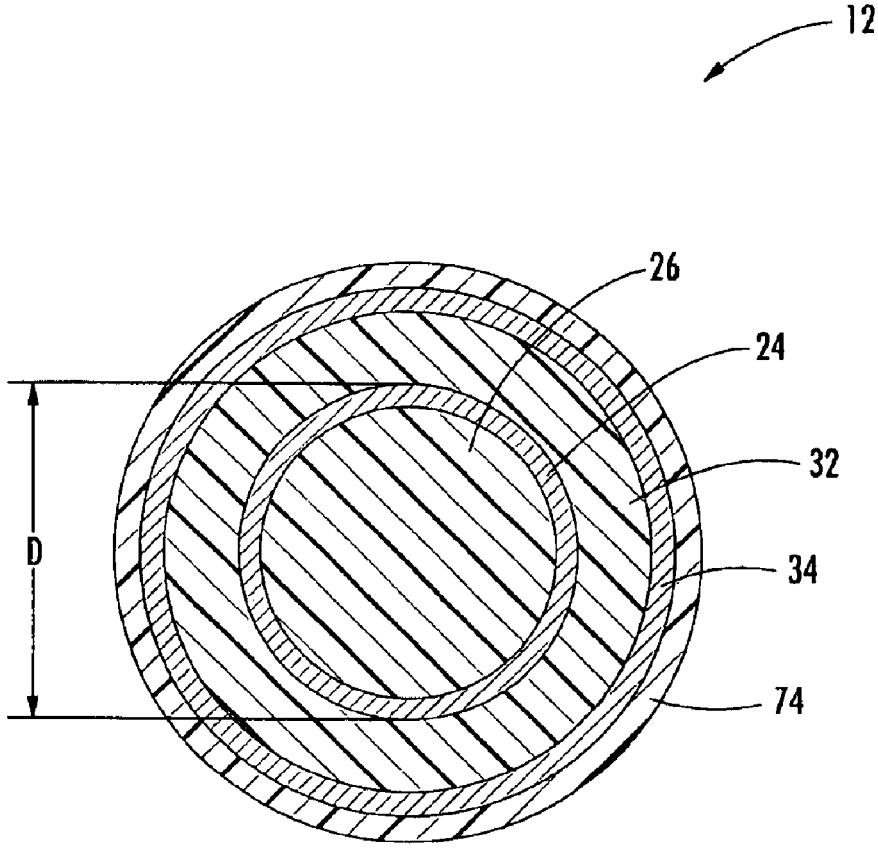
FIG. 14 is a transverse cross-sectional view of a coaxial cable made according to the present invention.

Returning again to FIGS. 1–3 and now to the cable transverse cross-section of FIG. 14, other aspects of the manufacturing process, apparatus and cable are now described. The conductive tube 24 downstream of the tube former 58 has a longitudinal seam 25. The longitudinal seam 25 is illustratively sealed at the seam welder 62 by a welding operation (Block 60). The seam welder 62, for example, may be a high-frequency induction welder. Other welding devices may alternatively be employed such as a gas tungsten arc welder, a plasma arc welder, or a laser welder as known to those skilled in the art. Still other devices and techniques of bonding the edges of the longitudinal seam 25 to one another may also be used, as will be readily understood by those skilled in the art.

The diameter of the conductive tube 24 is illustratively reduced by the reducing dies of the reducer 64 (Block 63) to a reduced diameter D (FIG. 14). Those skilled in the art will readily appreciate that other techniques and devices may be used to reduce the diameter of the conductive tube 24. Of course, diameter reduction may not be needed in other embodiments. The reduced diameter D is preferably in a range of 0.3 to 0.9 inches for some types of relatively large diameter coaxial cables.

Although the inner surface of the conductive tube 24 is illustratively smooth, it will be readily understood by those skilled in the art that the inner surface need not be smooth, and that the conductive tube may be made to have other surface configurations instead. For example, the conductive tube 24 may be made to have a corrugated surface rather than the illustrated smooth one.

The dielectric layer 32 is illustratively formed around the conductive tube 24 at Block 36 by the dielectric former 68. The dielectric former 68, for example, may include a cross-head extruder for extruding a dielectric polymer foam around the inner conductor, and, downstream therefrom, a series of cooling troughs or tanks to cool and solidify the dielectric foam as will be readily understood by those skilled in the art.

At Block 36, the outer conductor 34 is illustratively formed by the outer conductor former 72. This outer conductor former may also form a conductive strip into a larger tube around the dielectric layer 32 and weld the resulting longitudinal seam thereby defining the outer conductor 34. A jacket 74 of, for example, polyethylene, may be formed around the outer conductor 34 at Block 76 using a jacket former 78, which also may comprise an extruder as will be readily appreciated by those skilled in the art.

The forming of the dielectric layer 32 and outer conductor 34 accordingly may be performed continuously with the forming of the conductive tube 24. Similarly, the forming of the jacket 74 may be performed continuously with the forming of the inner conductor, the dielectric layer 32, and the outer conductor 34. Continuous in-line manufacturing can yield substantial cost savings compared to conventional approaches where the dielectric rod for the inner conductor is made separately in one or a series of processing steps.

The coaxial cable 12 so formed by these steps is illustratively wound onto a take-up reel 82 at Block 84. The method illustratively concludes at the stop (Block 86).

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that other modifications and embodiments are intended to be included within the scope of the appended claims.

That which is claimed is:

1. A method of making a coaxial cable comprising:

forming a conductive tube and setting a settable material therein to define an inner conductor;

forming a dielectric layer surrounding the inner conductor; and forming an outer conductor surrounding the dielectric layer.

2. A method according to claim 1 wherein forming the dielectric layer and outer conductor are performed continuously with forming the conductive tube.

3. A method according to claim 1 wherein setting comprises setting the settable material to completely fill the conductive tube.

4. A method according to claim 1 wherein setting comprises setting the settable material to radially fill longitudinally spaced apart portions of the conductive tube.

5. A method according to claim 1 further comprising winding the coaxial cable onto a take-up reel; and wherein setting comprises setting the settable material to form a stabilized inner conductor prior to winding on the take-up reel.

6. A method according to claim 1 wherein the settable material is also expandable; and wherein forming the conductive tube further comprises expanding the settable and expandable material within the conductive tube.

7. A method according to claim 6 wherein expanding comprises expanding by at least one of a chemical reaction, a temperature change, a pressure change, and exposure to optical energy.

8. A method according to claim 1 wherein forming the conductive tube comprises:

advancing a conductive strip along a path of travel;

bending the conductive strip into a tube having a longitudinal seam as it advances along the path of travel; and welding the longitudinal seam.

9. A method according to claim 8 wherein forming the conductive tube further comprises dispensing the settable material onto the conductive strip while advancing the strip along the path of travel.

10. A method according to claim 8 wherein forming the conductive tube further comprises dispensing the settable material onto the conductive strip prior to advancing the conductive strip along the path of travel.

11. A method according to claim 8 wherein forming the conductive tube comprises using at least one elongate pulling member secured within the conductive tube to dispense the settable material.

12. A method according to claim 11 wherein the at least one elongate pulling member carries at least part of the settable material.

13. A method according to claim 8 wherein forming the conductive tube further comprises reducing a diameter of the inner conductor after welding.

14. A method according to claim 1 wherein forming the conductive tube further comprises applying an adhesive layer within the conductive tube.

15. A method according to claim 1 wherein the settable material comprises at least one of polyurethane, polystyrene, and polyolefin.

16. A method according to claim 1 further comprising forming a jacket surrounding the outer conductor continuously with forming the inner conductor, dielectric layer, and outer conductor.

17. A method according to claim 1 wherein the conductive tube comprises copper.

18. A method of making a coaxial cable comprising:

forming a conductive tube by advancing a conductive strip along a path of travel, and bending the conductive strip into a tube having a longitudinal seam;

dispensing a settable material adjacent the conductive strip while forming the conductive tube, and setting the settable material in the conductive tube to thereby define an inner conductor;

forming a dielectric layer surrounding the inner conductor; and forming an outer conductor surrounding the dielectric layer.

19. A method according to claim 18 wherein forming the dielectric layer and outer conductor are performed continuously with forming the conductive tube.

20. A method according to claim 18 wherein setting comprises setting the settable material to completely fill the conductive tube.

21. A method according to claim 18 wherein setting comprises setting the settable material to radially fill longitudinally spaced apart portions of the conductive tube.

22. A method according to claim 18 further comprising winding the coaxial cable onto a take-up reel; and wherein setting comprises setting the settable material to form a stabilized inner conductor prior to winding on the take-up reel.

23. A method according to claim 18 wherein the settable material is also expandable; and wherein forming the conductive tube further comprises expanding the settable and expandable material within the conductive tube.

24. A method according to claim 23 wherein expanding comprises expanding by at least one of a chemical reaction, a temperature change, a pressure change, and exposure to optical energy.

25. A method according to claim 18 wherein dispensing comprises using at least one elongate pulling member secured within the conductive tube.

26. A method according to claim 18 wherein the settable material comprises at least one of polyurethane, polystyrene, and polyolefin.

27. A method of making a coaxial cable comprising:

forming a conductive tube by advancing a conductive strip having a settable material thereon along a path of travel, bending the conductive strip into a conductive tube having a longitudinal seam, and setting the settable material in the conductive tube formed by the bending of the conductive strip to thereby define an inner conductor;

forming a dielectric layer surrounding the conductive tube; and forming an outer conductor surrounding the dielectric layer.

28. A method according to claim 27 wherein forming the dielectric layer and outer conductor are performed continuously with forming the conductive tube.

29. A method according to claim 27 wherein the setting comprises setting the settable material to completely fill the conductive tube.

30. A method according to claim 27 wherein the setting comprises setting the settable material to radially fill longitudinally spaced apart portions of the conductive tube.

31. A method according to claim 27 further comprising winding the coaxial cable onto a take-up reel; and wherein setting comprises setting the settable material to form a stabilized inner conductor prior to winding on the take-up reel.

32. A method according to claim 27 wherein the settable material is also expandable; and further comprising expanding the settable and expandable material within the conductive tube.

33. A method according to claim 32 wherein expanding comprises expanding by at least one of a chemical reaction, a temperature change, a pressure change, and exposure to optical energy.

34. A method according to claim 27 wherein the settable material comprises at least one of polyurethane, polystyrene, and polyolefin.

* * * * *